US007749358B2

(12) United States Patent
Horsma-Aho et al.

(10) Patent No.: US 7,749,358 B2
(45) Date of Patent: Jul. 6, 2010

(54) INSTALLATION MODULE FOR A PAPER OR BOARD MACHINE

(75) Inventors: Simo Horsma-Aho, Muurame (FI); Jyrki Saloniemi, Muurame (FI); Jyrki Savela, Jyväskylä (FI); Henri Häkkinen, Jyväskylä (FI); Markku Hämäläinen, Jyväskylä (FI); Jussi Salojärvi, Kerava (FI); Risto Väätänen, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 454 days.

(21) Appl. No.: 11/916,850

(22) PCT Filed: Jun. 7, 2006

(86) PCT No.: PCT/FI2006/050239

§ 371 (c)(1),
(2), (4) Date: Dec. 13, 2007

(87) PCT Pub. No.: WO2006/131601

PCT Pub. Date: Dec. 14, 2006

(65) Prior Publication Data

US 2010/0139882 A1 Jun. 10, 2010

(30) Foreign Application Priority Data

Jun. 10, 2005 (FI) ..... 20055300

(51) Int. Cl.
*D21F 1/00* (2006.01)

(52) U.S. Cl. ..... 162/232; 52/79.1; 52/122.1; 34/117; 34/121

(58) Field of Classification Search ..... 162/232; 52/79.1, 122.1; 34/117, 121
See application file for complete search history.

(56) References Cited

U.S. PATENT DOCUMENTS

| | | | | | |
|---|---|---|---|---|---|
| RE30,280 | E | * | 5/1980 | Berman et al. | 290/1 R |
| 5,542,193 | A | * | 8/1996 | Sims et al. | 34/117 |
| 5,557,856 | A | * | 9/1996 | Kerttula | 34/117 |
| 5,829,159 | A | * | 11/1998 | Hodgins et al. | 34/121 |
| 5,884,415 | A | * | 3/1999 | Sims et al. | 34/117 |
| 6,030,327 | A | | 2/2000 | Suomalainen et al. | |
| 6,482,296 | B1 | * | 11/2002 | Fagerlund et al. | 162/253 |

FOREIGN PATENT DOCUMENTS

| | | | |
|---|---|---|---|
| DE | 19914053 | A1 | 9/2000 |
| WO | 2006/131601 | A1 | 12/2006 |

OTHER PUBLICATIONS

Written Opinion of the International Searching Authority PCT/FI2006/050239.
International Search Report PCT/FI2006/050239.
Search Report issued in priority application FI 20055300.

* cited by examiner

*Primary Examiner*—Mark Halpern
(74) *Attorney, Agent, or Firm*—Stiennon & Stiennon

(57) ABSTRACT

A wet end of a paper or board machine has at least one vertical, self-supporting installation module (10*a*, 10*b*) to be positioned into connection with the machine which module is supported from its lower end by foundation structures of the machine construction and which extends at least to the height of a second maintenance platform (50*b*) of the machine, which installation module (10) includes at least valves (40) and pipes (30) related to the hydraulic and/or pneumatic actuators of the machine.

16 Claims, 2 Drawing Sheets

INSTALLATION MODULE FOR A PAPER OR BOARD MACHINE

CROSS REFERENCES TO RELATED APPLICATIONS

This application is a U.S. national stage application of International App. No. PCT/FI2006/050239, filed Jun. 7, 2006, the disclosure of which is incorporated by reference herein, and claims priority on Finnish App. No. 20055300, filed Jun. 10, 2005.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an installation module for a paper or board machine.

The arrangement according to the invention relates to the equipment of a paper or board machine.

In paper or board machines according to prior art, the components and pipes of the equipment of the wet end i.e. the forming section and the press section with wires related to them are positioned on the driving side to several separate cabinets or otherwise to a large area in connection with the frame of the machine. This equipping can be started only when the frame of the machine has been erected. The equipping in question and designing related to it have to be made project-specifically taking the building, use of space and machine structure into consideration. Aforementioned matters lead to the fact that equipping the driving side becomes an expensive work phase which binds a lot of resources. Additionally, pipes to be installed on the frame could have been designed after the frame design in a hurry before purchasing the parts. This work phase also sets limitations on the schedule of commissioning, because equipping can be started only when the frame of the machine has been erected. The equipment in question includes, inter alia, apparatuses related to roll hydraulics, actuator hydraulics, pneumatics, lubrication and controls.

The maintainability of the components on the driving side becomes complicated resulting from scattered positioning and the narrowness of the wet end.

SUMMARY OF THE INVENTION

The installation module to be used in the arrangement according to the invention can be installed to the machine room even before the frame of the machine has been erected or simultaneously when erecting the frame of the machine or only after erecting the frame of the machine. The installation module is fastened from its lower end to the foundation structures of the machine construction, such as the floor of the machine room or the overlaying foundations of the floor or correspondingly to the floor structures or foundation structures of the basement. An opening has been made beforehand at the point in question on the floor of the machine room via which opening field pipes usually passing below the floor can be led to the installation module e.g. to the part underneath the floor of the installation module. The field pipes can naturally be led to the installation module also from the upper section of the installation module or between the lower and the upper section of the installation module. The installation module has prepared connections with which the field pipes can be connected to the module pipes of the installation module, which term "module pipes" will be used in this description of the pipes in the installation module. The installation module has also prepared connections with which the module pipes of the installation module can be connected to the actuator pipes going to actuators. These connections have been made to different heights in the installation module, whereby the pipes going from the installation module to the actuators can be positioned as functionally as possible.

In addition to the aforementioned module pipes, the installation module includes a set of valves related to the hydraulic and/or pneumatic actuators of the machine via which the module pipes of the installation module have been led. Thus, the valves can be centralized to one location close to the actuators, whereby the maintenance and monitoring of the valves are facilitated. In this description, the wiring in the installation module is referred to with the term module wiring and it can be realized with prefabricated wiring sets provided with connectors. The module wiring related to the pipes is led from the pipes in the installation module to connection strips in the installation module. From these connection strips, for their part, field wiring is led to the automation room. The field wiring can be brought centralized to the installation module in a corresponding way as the field pipes. Wire racks can be used between the installation module and the automation room via which racks the wiring is led. The installation module can also include e.g. bus-interface equipment, converters, pressure accumulators, blowers for pressurizing the belt roll etc.

The installation module in question can be constructed, equipped and tested complete already at the supplier of the paper or board machine and delivered as one package to the installation site. This considerably decreases equipping, installation work and testing required in connection with machine installation. When the module pipes in the installation module can be rinsed already in the initial assembly and testing, the need for rinsing the pipes decreases in connection with the commissioning of the machine.

Maintenance bridges can be fastened to the installation module already before the frame structure of the machine has been erected. These maintenance bridges can be utilized when erecting the frame structure of the machine. The operation and maintenance measures of the installation module and the machine can be performed from these maintenance bridges.

The use of the installation module facilitates later alterations to be made to the frame structures of the machine in connection with possible refurbishings, because the length and number of wires and pipes fastened to the frame structure can be decreased from current ones. The pipes coming from the installation module to the actuators are mainly supported to the maintenance bridges and the wires are installed on e.g. wire racks resting on the installation module.

With an arrangement according to the invention, the use of space and the structures of the driving side can be standardized at the wet end of the machine. On the tending side, usually there must be room at the wet end for exchanging fabrics, but e.g. in a situation in which seamable fabrics are used, the installation module according to the invention could be positioned either on the driving or tending side or possibly even on both sides.

The invention will now be described in detail with reference to the exemplifying embodiments of the figures of the accompanying drawing, to the details of which the invention is, however, by no means intended to be narrowly defined.

DESCRIPTION OF THE PREFERRED EMBODIMENTS

Figure 1:
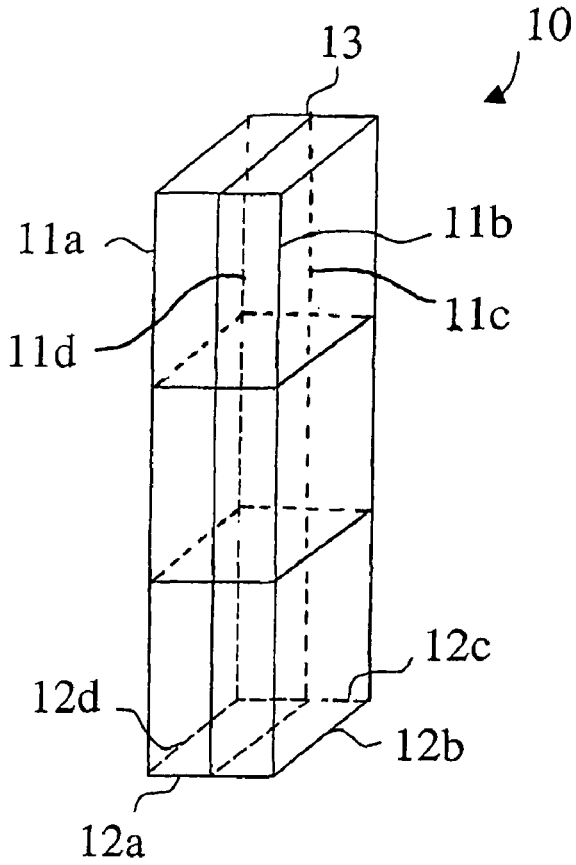
FIG. 1 schematically shows an axonometric drawing of an installation module according to the invention.
Figure 2:
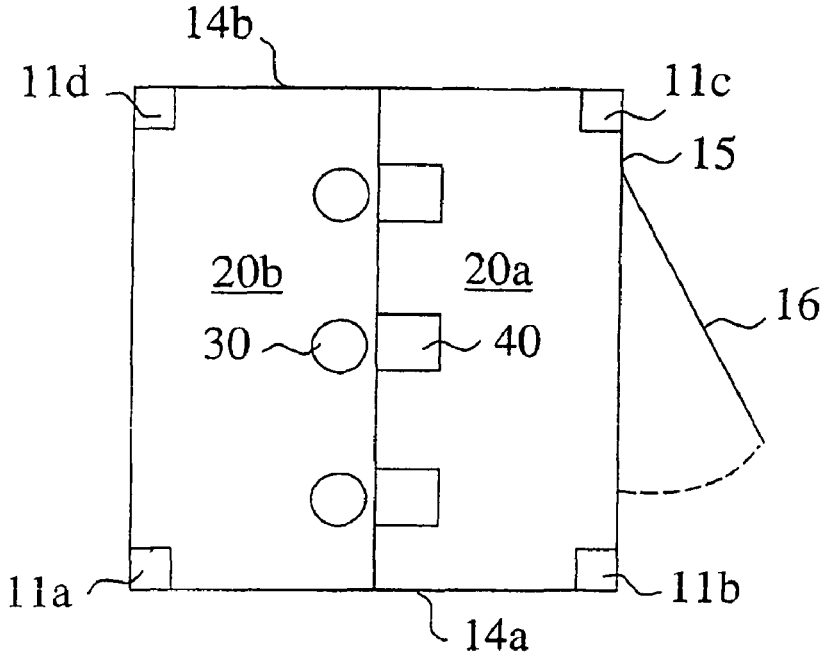
FIG. 2 schematically shows a cross-sectional view of an installation module according to the invention.

FIG. 1 shows an axonometric drawing of an installation module 10 according to the invention, and FIG. 2 shows a horizontal cross section of the installation module 10 in question. The installation module 10 is installed on the driving side KP of a paper or board machine at the wet end of the machine. The installation module 10 comprises a framework which is constituted of vertical supports 11*a*, 11*b*, 11*c*, 11*d* installed to the corners of a rectangle and middle supports 12*a*, 12*b*, 12*c*, 12*d* connecting them. There are middle supports at a suitable distance in the height direction of the installation module 10, whereby the framework is obtained adequately sturdy and self-supporting. As shown in FIG. 2, the framework has been divided into two compartments 20*a*, 20*b* with a dividing wall 13 fastened to the middle supports of the frame. Vertical banks of pipes 30 are positioned in one compartment 20*b* and valves 40 are positioned in the other compartment. The compartment 20*b* including the banks of pipes 30 can be open, but the compartment 20*a* including the valves 40 is advantageously closed with side walls 14*a*, 14*b* and a front wall 15. Advantageously, the front wall 15 has doors 16 via which the valves 40 can be accessed.

The installation module 10 is fastened from its lower end to the floor of the machine room. An opening has been formed beforehand at the point in question on the floor of the machine room via which opening the field pipes can be led to the installation module 10. The lower section of the installation module 10 has prepared connections with which the field pipes can be connected to the module pipes of the installation module 10. The upper section of the installation module, for its part, has prepared connections with which the module pipes of the installation module 10 can be connected to the actuator pipes going to actuators. These connections have been made to different heights in the installation module 10, whereby the actuator pipes going to the actuators from the installation module can be obtained as short as possible.

Figure 3:
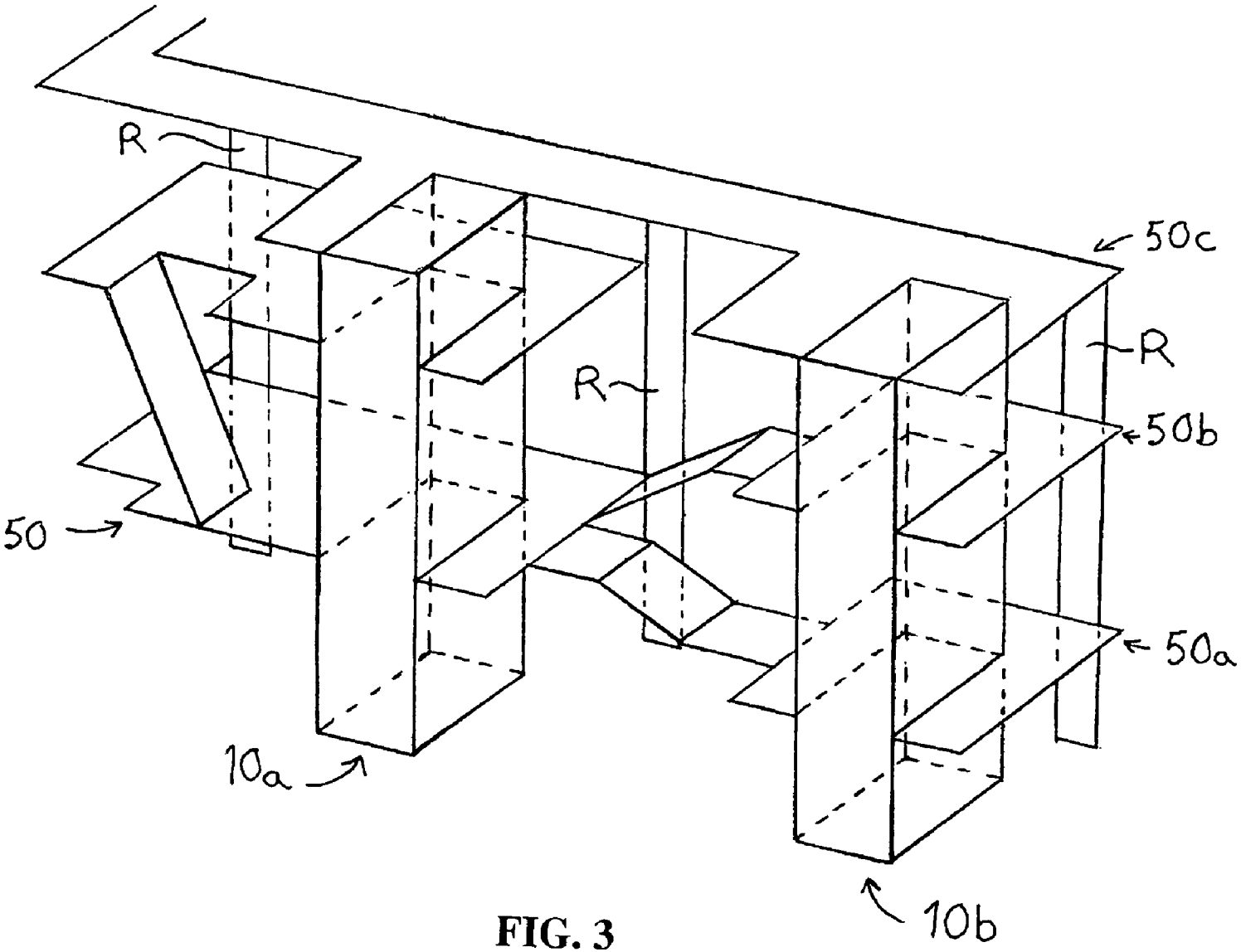
FIG. 3 schematically shows an axonometric drawing of two installation modules according to the invention in connection with the frame structure of the machine.

FIG. 3 schematically shows an axonometric drawing of two installation modules 10*a*, 10*b* according to the invention. Such an arrangement is well suited to be used in the press section provided with two separate press nips. The installation module 10*a*, 10*b* then includes sets of valves and pipes related to the rolls and actuators of one press nip. The figure shows the installation modules 10*a*, 10*b* and a part of maintenance bridges 50 fastened to them and a part of the frame structures R on the driving side of the machine. In connection with the second installation module 10*b*, three maintenance-bridge platforms 50*a*, 50*b*, 50*c* are shown. The undermost maintenance-bridge platform 50*a* is usually located at the height of 1-2 m from the floor of the machine room and the topmost i.e. third maintenance-bridge platform 50*c* is located on the level of the upper surface of the installation module 10 and the upper surface of the frame structures R of the machine so that a gap remains between the upper surface of the rails of the topmost maintenance-bridge platform 50*c* and the lower surface of the bridge crane overhead of the machine. The distance between the maintenance platforms 50*a*, 50*b*, 50*c* is about 2-3 m. The positions of the maintenance bridges 50*a*, 50*b*, 50*c* are dependent on the positions of the press nips and other equipment. In the case of two presses, the press nips are usually at different heights, whereby also the maintenance-bridge platforms supported by the first installation module 10*a* and the second installation module 10*b* are at different heights. The figure does not show machine components which are fastened to the frame structures R. The installation modules 10*a*, 10*b* are installed on the driving side of the machine to a distance from the frame structures R of the machine so that a passage can be constituted between the installation module 10*a*, 10*b* and the frame structure R of the machine with the maintenance bridges 50. The installation modules 10*a*, 10*b* extend at least to the height of the second maintenance-bridge platform 50*b* and advantageously to the whole height of the machine. The installation modules 10*a*, 10*b* extending to the whole height of the machine will give most opportunities in installing the maintenance bridges 50, actuator pipes and wiring.

The installation modules 10*a*, 10*b* can be installed to the machine room already before the erecting of the frame of the machine has begun. The installation modules 10*a*, 10*b* are fastened to the basic structures of the machine construction, such as e.g. on the floor of the machine room, after which the maintenance bridges 50 can be fastened to the installation modules 10*a*, 10*b* which bridges can be utilized when erecting the frame R of the machine. The wiring between the valves 40 in the installation module 10 and the actuators in the machine can be positioned on wire racks fastened to the maintenance bridges 50.

The installation modules 10*a*, 10*b* are advantageously positioned at a distance from the frame structures R of the driving side of the machine. Positioning at a distance from the frame structures R of the machine is advantageous, because then it is possible to arrange a passage to the maintenance and operating personnel on the maintenance bridges between the installation modules 10*a*, 10*b* and frame structures R. The installation modules 10*a*, 10*b* can naturally be positioned right next to the frame R, if it does not prevent access or visibility to the maintenance items of frames, rolls and equipment. When the installation modules 10*a*, 10*b* are installed right next to the frame R, the length of the actuator pipes can be minimized.

The typical external dimensions of the installation module 10*a*, 10*b* are: width 1 m, depth 2 m and height 7 m. With these dimensions, two installation modules 10*a*, 10*b* fit to a same standard-dimensioned container. The distance of the installation module 10*a*, 10*b* from the frame structures R of the machine is of the order of 1 m, whereby there is enough room for the operating and maintenance personnel to walk on the maintenance bridges 50 between the installation module 10*a*, 10*b* and the frame R.

FIG. 3 shows two installation modules 10*a*, 10*b* in connection with a press section provided with two separate presses, but it is naturally also possible to use only one installation module in connection with the press section provided with two separate presses. Then however, the length of the actuator pipes and the actuator wiring increases.

In the embodiment of the figures, the cross section of the installation module 10 constitutes a rectangle, but naturally the shape of the cross section of the installation module 10 can be whichever. The rectangular cross section is, however, advantageous from the viewpoint of positioning and supporting the maintenance bridges 50.

In the embodiment shown in the figures, the installation module 10 is based on a carrying framework, but the installation module 10 can also be realized e.g. with a carrying sheet frame, whereby e.g. cellular sheet-metal structures can be used.

Next, the patent claims are presented, within the scope of their inventive idea the details of the invention may vary from the ones presented above only as examples.

The invention claimed is:

1. A paper or board machine comprising:

a wet end having a drive side and a tending side, the wet end further comprising:

a machine construction mounted to foundation structures, having a first maintenance platform of a first height, and a second maintenance platform of a second height; and at least one vertical, self-supporting installation module installed in connection with the wet end, the module having a lower end supported by the foundation structures and extending at least to the height of a second maintenance platform, wherein the installation module includes at least valves and pipes, for connecting to hydraulic or pneumatic actuators of the machine.

2. The paper or board machine of claim 1 wherein the at least one installation module further comprises a framework which is comprised of vertical supports, middle supports connecting the vertical supports at regular intervals in the height direction, and a dividing wall which divides the at least one installation module into a first space and a second space.

3. The paper or board machine of claim 2 wherein the first space is closed with side walls and a front wall.

4. The paper or board machine of claim 3 wherein the front wall of the first space has at least one door.

5. The paper or board machine of claim 3 wherein the second space is open.

6. The paper or board machine of claim 2 wherein the first space includes the valves.

7. The paper or board machine of claim 2 wherein the second space includes the pipes.

8. The paper or board machine of claim 1 wherein the at least one installation module is located on the driving side of the wet end at a distance from frame structures forming the wet end.

9. The paper or board machine of claim 1 further comprising maintenance bridges fastened to the installation module from which operating and maintenance personnel can perform maintenance and operating measures of both the at least one installation module and the paper or board machine.

10. The paper or board machine of claim 1 wherein a horizontal cross section of the at least one installation module is of rectangular shape.

11. The paper or board machine of claim 1 wherein the installation module has mounted thereto, bus-interface equipment, converters, pressure accumulators, and blowers.

12. A method of constructing a paper or board machine wet end comprising the steps of:

erecting a frame of a papermaking machine on a machine foundation structure, in a machine room, the machine room having a machine room floor;

constructing an installation module, having a lower end, the installation module including a set of valves, and modular pipes connected to the valves, and module wiring provided with connectors;

before installing the installation module, testing the valves and module wiring;

before, simultaneous with, or after erecting the frame, installing the installation module with the module pipes, and the valves, and module wiring mounted thereto by fastening the lower end of the installation module to the foundation structure over a portion of the machine room floor;

before installing the installation module, making an opening in said portion of the machine room floor;

passing field pipes from below the floor and through the opening in said portion of the machine room floor, and leading said field pipes into the installation module;

connecting the field pipes to the module pipes mounted to the installation module; and connecting the module pipes to actuator pipes going to actuators forming a part of the paper or board machine.

13. The method of claim 12 further comprising the steps of:

fastening to the installation module a plurality of maintenance bridges before the frame structure of the machine is erected; and utilizing the maintenance bridges when erecting the frame structure of the machine.

14. The method of claim 12 further comprising the step of before installing the installation module, rinsing the module pipes in the installation module.

15. The method of claim 12 further comprising the steps of leading the module wiring, which is related to the module pipes in the installation module, to connection strips in the installation module and from the connection strips leading field wiring to an automation room.

16. The method of claim 12 further comprising the steps of constructing the installation module with bus-interface equipment, converters, pressure accumulators, and blowers for pressurizing a belt roll.

* * * * *